United States Patent [19]

Sugasawa et al.

[11] 4,385,600

[45] May 31, 1983

[54] SPLIT TYPE INTERNAL COMBUSTION ENGINE

[75] Inventors: Fukashi Sugasawa, Yokohama; Haruhiko Iizuka, Yokosuka; Yukihiro Etoh, Yokohama; Toshiaki Tanaka, Fujisawa, all of Japan

[73] Assignee: Nissan Motor Company, Ltd., Yokohama, Japan

[21] Appl. No.: 140,665

[22] Filed: Apr. 15, 1980

[30] Foreign Application Priority Data

Apr. 18, 1979 [JP] Japan ..... 54-47438

[51] Int. Cl.[3] ..... F02B 77/00

[52] U.S. Cl. ..... 123/198 F; 123/481

[58] Field of Search ..... 123/198 F, 481

[56] References Cited

U.S. PATENT DOCUMENTS

| | | | |
|---|---|---|---|
| 4,076,003 | 2/1978 | Garabedian | 123/198 F |
| 4,080,947 | 3/1978 | Iizuka | 123/198 F |
| 4,143,635 | 3/1979 | Iizuka et al. | 123/198 F |
| 4,144,863 | 3/1979 | Abdoo | 123/198 F |
| 4,146,006 | 3/1979 | Garabedian | 123/198 F |
| 4,153,033 | 5/1979 | Iizuka | 123/198 F |
| 4,263,782 | 4/1981 | Matsumoto | 123/198 F |
| 4,274,382 | 6/1981 | Sugasawa | 123/481 |
| 4,296,719 | 10/1981 | Takahashi | 123/198 F |

FOREIGN PATENT DOCUMENTS

| | | | |
|---|---|---|---|
| 508395 | 1/1977 | Australia . | |
| 2612172 | 9/1977 | Fed. Rep. of Germany . | |
| 1108703 | 1/1956 | France . | |
| 579554 | 8/1946 | United Kingdom . | |
| 649292 | 1/1951 | United Kingdom . | |
| 812862 | 5/1959 | United Kingdom . | |
| 1319671 | 6/1973 | United Kingdom . | |
| 1537300 | 12/1978 | United Kingdom | 123/198 F |
| 2001131 | 1/1979 | United Kingdom . | |

*Primary Examiner*—Ronald B. Cox

*Attorney, Agent, or Firm*—Schwartz, Jeffery, Schwaab, Mack, Blumenthal & Koch

[57] ABSTRACT

An internal combustion engine is disclosed which includes first and second cylinder units each having at least one cylinder, and a control unit responsive to engine load for rendering the first and second cylinder units active at high load conditions and rendering the second cylinder unit inactive when the engine load is below a predetermined value. A rapid acceleration detector is provided which is responsive to rapid engine acceleration for causing the control unit to render the first and second cylinder units active regardless of the engine load.

4 Claims, 4 Drawing Figures

SPLIT TYPE INTERNAL COMBUSTION ENGINE

BACKGROUND OF THE INVENTION

1. Field of the Invention

This invention relates to an internal combustion engine of the split type operable on less than all of the cylinders when the engine load is below a given value and, more particularly, to improvements in such an engine where engine operation is shifted to a full engine mode at a fast speed in response to rapid engine acceleration.

2. Description of the Prior Art

It is generally known that internal combustion engines demonstrate higher fuel combustion and thus higher fuel economy when running under higher load conditions. In view of this fact, split type internal combustion engine have already been proposed as automotive vehicle engines or the like. Such split type internal combustion engines include an active cylinder unit having at least one cylinder being always active and an inactive cylinder unit having at least one cylinder being inactive when the engine load is below a given value. At low load conditions, the flow of fuel to the inactive cylinder unit is cut off so that the engine operates only on the active cylinder unit for relatively increased active cylinder loads resulting in high fuel economy. In such an engine, control means is provided for shifting engine operation between its full and split engine modes in response to fuel injection pulses determined by the intake air flow rate indicative directly of engine load.

One difficulty with such an engine is that the speed which engine operation is shifted to its full engine mode from its split engine mode is too slow to achieve required engine output when rapid engine acceleration occurs. The reason for this is that the intake air flow rate does not increase with an increase in the degree of opening of the throttle valve during rapid acceleration but increases at a time after the throttle valve rapidly opens.

SUMMARY OF THE INVENTION

It is therefore one object of the present invention to provide an improved split type internal combustion engine which is free from the disadvantages found in conventional split engines.

Another object of the present invention is to provide means to shift engine operation from a split engine mode to a full engine mode at a fast speed in response to rapid engine acceleration.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particuarly pointed out in the appended claims.

BRIEF DESCRIPTION OF THE DRAWINGS

The present invention will be described in greater detail by reference to the following description taken in connection with the accompanying drawings, in which.

DESCRIPTION OF THE PREFERRED EMBODIMENT

Although the present invention will be described in connection with a 6-cylinder split engine including three active cylinders being always active and three inactive cylinders being inactive when the engine load is below a given value, it is to be noted that this invention could be readily applied to any split engine structure including engines equipped with carburetors.

Figure 1:
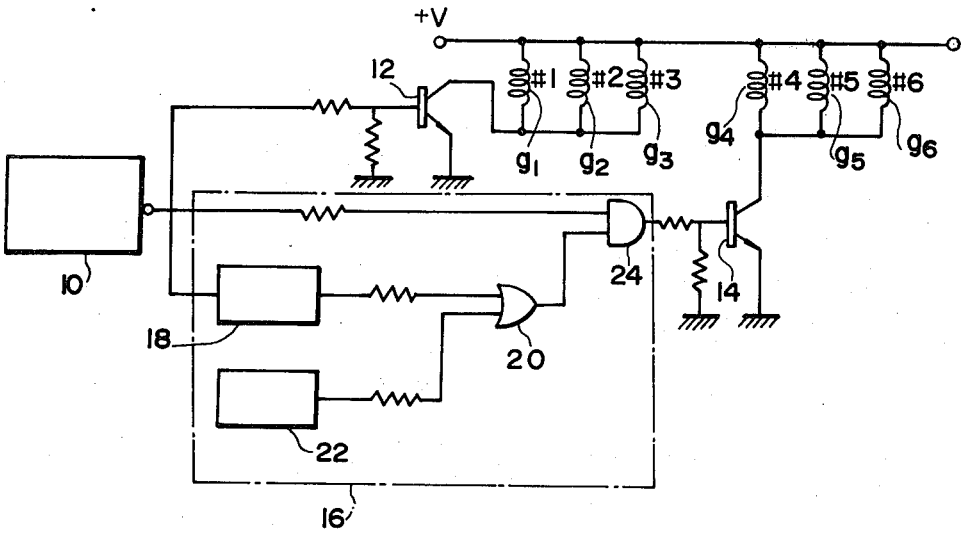
FIG. 1 is a control diagram showing one embodiment of the present invention.

Referring now to FIG. 1, the reference numeral 10 designates a pulse generator adapted to provide at its output fuel injection pulses of a pulse width determined by the intake air flow rate which is indicative indirectly of engine load. The output of the pulse generator 10 is coupled to first valve drive means 12 and also to second valve drive means 14 through a split engine control circuit 16. The first valve drive means 12 is responsive to the fuel injection pulses for operating a first group of fuel injection valves $g_1$ to $g_3$ associated with the respective active cylinders #1 to #3 so as to supply thereinto a controlled amount of fuel proportional to the pulse width of the fuel injection pulses. The first valve drive means 12 may comprise a switching transistor responsive to the fuel injection pulses for switching on and off the drive current flowing through the first group of fuel injection valve $g_1$ to $g_3$. The second valve drive means 14 is substantially similar in structure to the first valve drive means 12 and is responsive to the fuel injection pulses for operating a second group of fuel injection valves $g_4$ to $g_6$ associated with the respective inactive cylinders #4 to #6 so as to supply thereinto a controlled amount of fuel proportional to the pulse width of the fuel injection pulses.

The split engine control circuit 16 includes a load detector 18 operable to compare the pulse width of the fuel injection pulses with a reference value and to provide a low output when the pulse width is below the reference value; that is, at low load conditions and a high output when the pulse width is above the reference value; that is, at high load conditions. The output of the load detector 18 is connected to one input of an OR gate 20, the other input of which is coupled to the output of a rapid acceleration detector 22 which is adapted to provide a high output during rapid engine acceleration.

Figure 2:
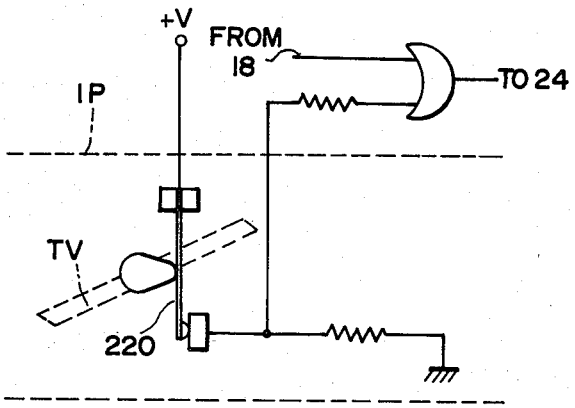
FIGS. 2 to 4 are diagrams showing several examples of the rapid acceleration detector for use in the control system of FIG. 1.
Figure 3:
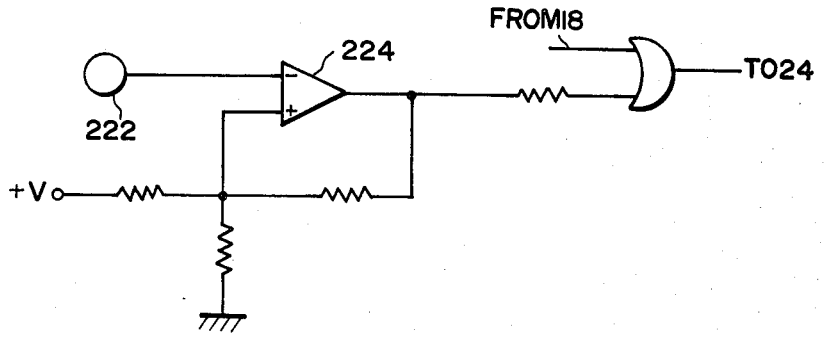
Figure 4:
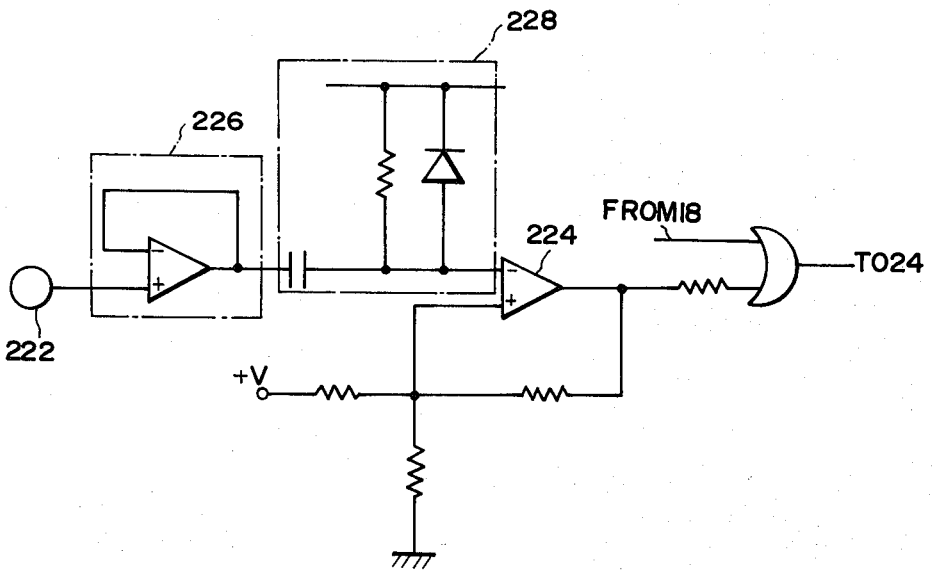

Referring to FIG. 2, a rapid acceleration detector in the form of a position detector 22 is shown as comprising a throttle switch 220 associated with a throttle valve TV located in the induction passage IP of the engine such that the switch 220 conduct a DC voltage to the other input of the OR gate 20 when the degree of opening of the throttle value TV is greater than a predetermined value. Alternatively, the rapid acceleration detector 22 may comprises a throttle position sensor 222 such as a potentiometer or the like, as shown in FIG. 3, which is adapted to monitor the degree of opening of the throttle valve and provide a voltage signal corresponding to the throttle opening degree. The output of the throttle position sensor 222 is coupled to a comparator 224 which provides a high output when the output of the throttle position sensor 222 is higher than a reference voltage. As shown in FIG. 4, the output of the throttle position sensor 222 may be applied to the comparator 224 through an amplifier 226 and a differentiation circuit 228, in which case the voltage at the output of the differentiation circuit 228 decreases with a decrease in the rate of decrease of the output of the throttle position sensor 222.

Referring back to FIG. 1, the output of the OR gate 20 is coupled to one input of an AND gate 24, the other input of which is coupled to the output of the pulse generator 10. The output of the AND gate 24 is connected to the input of the second valve drive means 14. The AND gate 24 allows the passage of the fuel injection pulses to the second valve drive means 14 when either of the outputs of the load detector 18 and the rapid acceleration detector 22 is high.

Assuming now that the throttle valve is at a small opening degree and thus a small amount of air is introduced to the engine, both of the outputs of the load detector 18 and the rapid acceleration detector 22 and low. Consequently, the output of the OR gate 20 is low to cause the AND gate 24 to interrupt the passage of the fuel injection pulses to the second valve drive means 14. As a result, the inactive cylinders #4 to #6 are supplied with no fuel and are held inoperative whereby the engine is placed in a 3-cylinder mode of operation.

When the throttle valve is rapidly opened over a predetermined value, the amount of air to the engine increases, at a slow rate in the beginning of rapid acceleration and then rapidly with an increase in the speed of rotation of the engine. If the rapid acceleration detector 22 is not provided, the output of the load detector 18 will be held low during the beginning of rapid acceleration and thus the engine is held in a 3-cylinder mode of operation until the intake air flow rate increases to such an extent as to cause the load detector 18 to provide a high output. That is, without the rapid acceleration detector 22, the engine is shifted from its 3-cylinder mode to its 6-cylinder mode a time after rapid acceleration occurs. In addition, the engine operation mode shifting is delayed due to some response delays inherent in the intake air flow rate monitoring sensor.

In the present invention, at the same time as the throttle valve opens over the predetermined value, the output of the rapid acceleration detector 22 changes to its high level. Thus, the output of the OR gate 20 is changed to its high level, causing the AND gate 24 to allow the passage of the fuel injection pulses to the fuel injection valves $g_4$ to $g_6$. As a result, engine operation is shifted to the full or in this case, 6-cylinder mode. That is, the speed with which engine operation changes from a 3-cylinder mode to a 6-cylinder mode after rapid acceleration occurs is very high.

Although the rapid acceleration detector 22 has been described as associated with an intake air flow rate monitoring sensor, it is to be noted that it may be designed to detect rapid acceleration in accordance with the amount of depression of the accelerator pedal or the rate of change in the displacement of the accelerator pedal or the throttle valve.

In split engines where a stop valve is provided for allowing or interrupting the flow of fresh air to the inactive cylinders #4 to #6 in order to prevent exhaust gas temperature reduction, the output of the rapid acceleration detector may be used to control the opening and closing of the stop valve.

There has been described, in accordance with the present invention, a split type internal combustion engine employing a rapid acceleration detector to shift engine operation from a split engine mode to a full engine mode with high response to rapid acceleration. While the present invention has been described in conjunction with a specific embodiment thereof, it is evident that many alternatives, modifications and variations will be apparent to those skilled in the art. Accordingly, it is intended to embrace all alternatives, modifications and variations that fall within the spirit and broad scope of the appended claims.

What is claimed is:

1. An internal combustion engine comprising:

(a) first and second cylinder units, each including at least one cylinder;

(b) an induction passage leading to said first and second cylinder units, said induction passage having therein a throttle valve;

(c) a control means responsive to engine load conditions for disabling said second cylinder unit when the engine load is below a predetermined value; and (d) means for providing a command signal to cause said control means to hold said second cylinder unit active regardless of engine load conditions when the rate of change of opening of said throttle valve is above a predetermined value.

2. An internal combustion engine comprising:

(a) first and second cylinder units each including at least one cylinder;

(b) an induction passage leading to said first and second cylinder units, said induction passage having therein a throttle valve drivingly associated with an accelerator pedal;

(c) a control means, responsive to engine load conditions, for disabling said second cylinder unit when the engine load is below a predetermined value; and (d) means for providing a command signal to cause said control means to hold said second cylinder unit active regardless of engine load conditions when the rate of change in the depression of said accelerator pedal is above a predetermined value.

3. The engine of claim 1, wherein said means comprises a sensor adapted to provide a signal indicative of the degree of opening of said throttle valve, a circuit for differentiating the signal from said sensor, and a comparator operable to provide the command signal to said control means when the output of said circuit is above a predetermined value.

4. The engine of claim 2, wherein said means comprises a sensor adapted to provide a signal indicative of the depression of said accelerator pedal, a circuit for differentiating the signal from said sensor, and a comparator operable to provide the command signal to said control unit when the output of said circuit is above a predetermined value.

* * * * *